United States Patent [19]

Morse

[11] Patent Number: 4,759,692

[45] Date of Patent: Jul. 26, 1988

[54] INTEGRAL INTERNAL PRESSURE RELIEF VALVE

[75] Inventor: Robert L. Morse, Adrian, Mich.

[73] Assignee: Tecumseh Products Company, Tecumseh, Mich.

[21] Appl. No.: 64,770

[22] Filed: Jun. 22, 1987

[51] Int. Cl.[4] ..... F04D 49/02; B23P 15/00

[52] U.S. Cl. ..... 417/307; 29/157.1 R

[58] Field of Search ..... 417/307, 311, 559; 29/157.1 R

[56] References Cited

U.S. PATENT DOCUMENTS

| | | | |
|---|---|---|---|
| 1,692,395 | 11/1928 | Thomas | 417/307 |
| 2,405,466 | 8/1946 | Tabb | 417/307 |
| 2,812,893 | 11/1957 | Cotter | 417/307 |
| 2,929,551 | 3/1960 | Heidorn | 417/269 |
| 3,255,954 | 6/1966 | Norlin et al. | 417/311 |
| 3,373,763 | 3/1968 | Sarilges et al. | 417/307 |
| 3,442,491 | 5/1969 | Messerschmidt | 29/157.1 R |
| 3,570,095 | 3/1971 | Miner | 29/157.1 R |
| 3,679,328 | 7/1972 | Cattanach | 470/270 |
| 3,759,057 | 9/1973 | English et al. | 62/196 |
| 4,270,885 | 6/1981 | Schaeffer et al. | 417/308 |
| 4,408,967 | 10/1983 | Unger et al. | 417/571 |
| 4,427,346 | 1/1984 | Romer | 417/292 |
| 4,459,817 | 7/1984 | Inagaki et al. | 62/196.3 |
| 4,522,568 | 6/1985 | Gelse et al. | 417/307 |
| 4,688,312 | 8/1987 | Sasao | 29/157.1 R |

FOREIGN PATENT DOCUMENTS

| | | | |
|---|---|---|---|
| 451612 | 10/1948 | Canada | 417/307 |
| 982927 | 2/1963 | United Kingdom | 417/307 |
| 1563463 | 3/1980 | United Kingdom | 417/564 |

*Primary Examiner*—William L. Freeh

*Attorney, Agent, or Firm*—Jeffers, Hoffman & Niewyk

[57] ABSTRACT

A pressure relief valve for a hermetically sealed reciprocating piston compressor is disclosed in which a bore in a compressor cylinder head defines the valve body. Valve components are introduced into the bore through a valve opening on the bottom surface of the cylinder head. A discharge pressure chamber in the cylinder head also has a discharge pressure opening on the bottom surface. A path is provided between the valve opening and the discharge pressure opening, when the compressor is assembled, by means of a duct in a valve plate interposed between the cylinder head and a compressor crankcase. Also disclosed is a method for assembling the pressure relief valve in a cylinder head, whereby the valve components are temporarily retained within the bore by a washer-shaped soft metal valve seat that is compressed and expanded into an annular undercut or recess in the bore located adjacent to the bottom surface of the cylinder head. Upon final assembly of the cylinder head to the crankcase, the valve seat and other valve components are positively retained within the bore.

5 Claims, 3 Drawing Sheets

INTEGRAL INTERNAL PRESSURE RELIEF VALVE

BACKGROUND OF THE INVENTION

The present invention relates to a reciprocating piston compressor, and in particular to a compressor wherein, in the event of abnormal compressor operating conditions, a pressure relief valve provides a leakage path between high and low pressure regions in the compressor.

More particularly, the present invention is applicable to a reciprocating piston compressor in which overpressure conditions may occur in a cylinder head of the compressor during operation. In order to prevent damage to the compressor assembly, a pressure relief valve communicating with discharge pressures in the cylinder head is required. The pressure relief valve operates to vent excessive pressures in the cylinder head to a region of lower pressure, i.e., compressor suction pressure, when the discharge pressure reaches a predetermined differential value, with respect to the suction pressure, below that which would cause damage to the compressor assembly.

A typical prior art internal pressure relief valve used in a compressor assembly consists of a valve body encapsulating various valve components such as a valve seat, a ball, a piston, and a spring. The valve body includes a threaded portion that is assembled into the cylinder head by means of a threaded bore communicating directly with a discharge pressure chamber in the cylinder head.

There are several problems and disadvantages associated with using the aforementioned prior art pressure relief valve in a compressor assembly. For example, because the valve body extends outwardly from the cylinder head, space immediately surrounding the cylinder head is required, thereby leaving less room for other compressor components or resulting in a larger compressor. Also, some form of gasket is required to seal the valva in its mounted position to prevent unintended pressure leakage. Furthermore, a tapped hole must be provided in the cylinder head to mount the valve.

Further considerations of manufacturability and cost make using the aforementioned pressure relief valve undesirable. For instance, when a used compressor is rebuilt or reconditioned, a new entire valve assembly must be used in order to ensure the integrity of its internal valve components. Also, during initial manufacturing of the compressor assembly, the pressure relief valve must be manufactured independently of the other compressor components and then assembled onto the cylinder head.

SUMMARY OF THE INVENTION

The problems and disadvantages of the aforementioned pressure relief valve are overcome by the present invention wherein a pressure relief valve is disposed within the cylinder head. It is desired to provide a pressure relief valve for a reciprocating piston compressor that does not require space immediately surrounding the cylinder head, is easily assembled without tapped holes and separate gaskets, and allows for replacement of individual valve components.

Accordingly, the present invention provides an integral internal pressure relief valve for a reciprocating piston compressor that features a valve body defined by a bore in the cylinder head, thereby eliminating the need for a separate valve body component extending from the cylinder head.

More specifically, in accordance with one form of the present invention, a valve body defined by a bore in the cylinder head accommodates various valve components including a valve spring, a valve piston, a ball, and a valve seat. A valve opening, or inlet aperture, provides communication between the pressure relief valve and the bottom surface of the cylinder head. A discharge opening provides communication between a discharge pressure chamber in the cylinder head and the bottom surface of the cylinder head. A duct in the valve plate provides communication between the discharge opening and the valve opening when the compressor is operatively assembled. Therefore, when pressure in the discharge pressure chamber of the cylinder head reaches a level capable of unseating the valve ball, pressure is vented outside the cylinder head through a vent hole intersecting the valve bore. A hole in the top surface of the cylinder head communicating with the valve bore allows an instrument to be inserted therethrough for calibration of the valve or easy removal of the valve components through the valve opening.

In accordance with another form of the present invention, a method of assembling a reciprocating piston compressor involves providing a pressure relief valve body defined by a bore in the cylinder head having a valve opening in the bottom surface of the cylinder head. An annular undercut is provided in the valve bore at a location adjacent to the valve opening at the bottom of the cylinder head. Various valve components are introduced into the cylinder bore and temporarily retained therein by a valve seat that is compressed and expanded into the annular undercut. The valve seat and other valve components are permanently retained within the valve bore when the cylinder head is operatively assembled onto the compressor crankcase.

One advantage of the pressure relief valve of the present invention is that the valve body of a typical valve is eliminated and replaced by a bore in the cylinder head.

Another advantage of the present invention is that a tapped hole in the cylinder head is no longer needed to mount a typical pressure relief valve.

A further advantage of the present invention is that space immediately surrounding the cylinder head is no longer needed for a pressure relief valve extending therefrom.

Yet another advantage of the present invention is that no additional gasket or seal is needed for mounting a pressure relief valve in the cylinder head to communicate with a source of discharge pressure.

Another advantage of the present invention is that a calibration or knock-out hole is conveniently located in the top of the cylinder head.

A further advantage of the present invention is that individual component parts of the pressure relief valve can be replaced, thereby avoiding costs associated with replacing the entire valve.

Yet another advantage of the present invention is that internal passageways between chambers in the cylinder head are simplified by providing openings to the bottom surface of the cylinder head.

One advantage of the manufacturing method of the present invention is that, during manufacturing, the pressure relief valve may be temporarily retained in the cylinder head as an intermediate manufacturing step for later assembly with the valve plate and crankcase.

Another advantage of the manufacturing method of the present invention is that the valve seat component of the valve is also used for temporarily mounting the valve components within the valve bore during an intermediate step of assembling the compressor.

The invention in one form thereof, provides a pressure relief valve for a compressor including a crankcase and a cylinder head having a discharge pressure chamber, for relieving pressure from the discharge pressure chamber. The pressure relief valve includes a valve body defined by a bore in the cylinder head, wherein the valve body has a valve opening in the bottom surface of the cylinder head. The bottom surface of the cylinder head is defined as that surface adjacent to the crankcase when the cylinder head and crankcase are operatively assembled. The pressure relief valve also includes a valve mechanism received within the valve body and retained therein by the adjoining top surface of the crankcase adjacent to the valve opening when the cylinder head and the crankcase are operatively assembled.

The invention further provides, in one form thereof, a pressure relief valve for a hermetic reciprocating piston compressor. The compressor includes, in assembled order, a cylinder head, a cylinder head gasket, a valve plate, a valve plate gasket, and a crankcase. The cylinder head has a bottom surface defined as that surface adjacent to the top surface of the crankcase. The cylinder head also has a discharge pressure chamber communicating with the bottom surface of the cylinder head through a discharge aperture. The pressure relief valve includes a valve body defined by a bore in the cylinder head. The valve body includes an inlet aperture communicating with the bottom surface of the cylinder head and an outlet aperture communicating with a source of compressor suction pressure. The valve further includes a pressure valve mechanism located within the valve body providing pressure relief valving between the inlet aperture and the outlet aperture. Duct means external to the cylinder head provide sealed communication between the discharge aperture and the inlet aperture. Accordingly, excessive pressure in the discharge chamber is vented successively through the discharge aperture, the duct means, the inlet aperture, the valve mechanism, and the outlet aperture into the source of compressor suction pressure.

The invention, in accordance with another embodiment thereof, provides a method of assembling a compressor including a crankcase having a top surface, a cylinder head having a bottom surface for cooperatively engaging the top surface of the crankcase, and a pressure relief valve comprising a valve body and a valve mechanism for relieving pressure from a discharge pressure chamber in the cylinder head. One step of the method of assembling a compressor is to provide a bore in the cylinder head having an opening in the bottom surface thereof. The bore defines the valve body and the bore is capable of receiving the valve mechanism through the bore opening. Another step of the method of the present invention is to introduce the valve mechanism into the valve body through the bore opening. The valve mechanism is operatively oriented in the valve body to respond to pressures being introduced through the bore opening. A further step in the method of assembling a compressor is to hold or retain the valve mechanism within the valve body until the cylinder head is operatively mounted on the top surface of the crankcase, thus causing the valve mechanism to be positively retained within the valve body during compressor operation.

It is an object of the present invention to provide a pressure relief valve that does not require space immediately surrounding the compressor cylinder head.

It is another object of the present invention to provide a pressure relief valve that does not require separate gaskets or seals for mounting the valve to the compressor.

It is yet another object of the present invention to provide a pressure relief valve wherein individual valve components may be replaced without replacing the valve body component.

A further object of the present invention is to provide a pressure relief valve that does not require a tapped hole for mounting.

A still further object of the present invention, in one form thereof, is to provide a pressure relief valve that is easily calibrated.

A further object of the present invention, in one form thereof, is to provide a method of assembling a compressor wherein a pressure relief valve may be assembled integrally with other components of the compressor.

These and other objects of the present invention will become apparent from the detailed description taken together with the accompanying drawings.

DESCRIPTION OF THE PREFERRED EMBODIMENT

Figure 1:
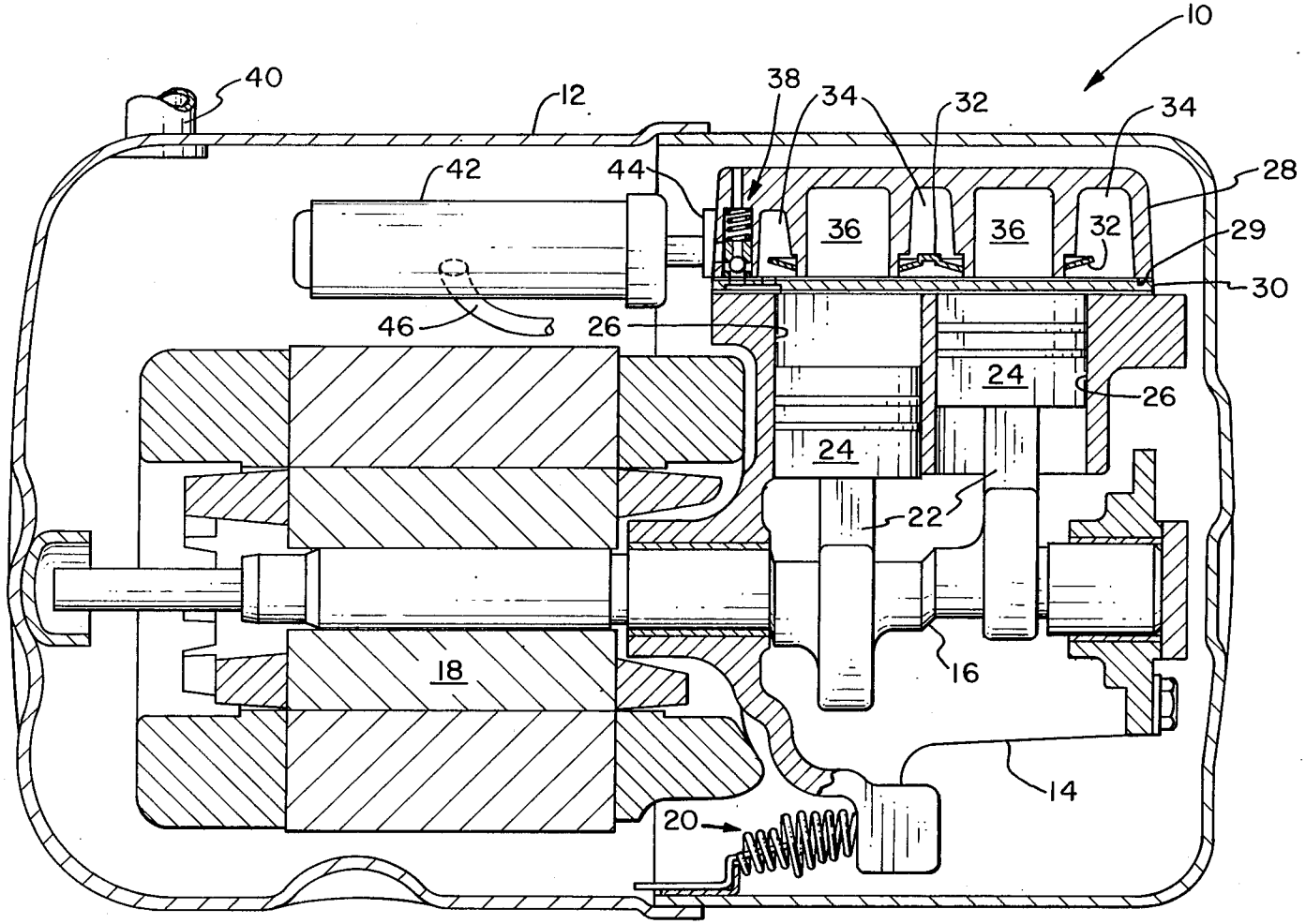
FIG. 1 is an elevational sectional view of a compressor incorporating a preferred embodiment of the present invention.

Referring to the drawings, and in particular to FIG. 1, there is shown a hermetically sealed, reciprocating piston compressor 10 of the type to which the present invention is applicable. Compressor 10 includes a sealed compressor housing 12 encapsulating the remainder of the compressor components. Disposed within housing 12 is a crankcase 14 supporting a crankshaft 16 which is driven by a motor 18. Shock mounts 20 attached to crankcase 14 and housing 12 suspend the compressor components within housing 12.

By way of illustration, and without any limitation on the invention, orientation of compressor 10 in the illustrated preferred embodiment is with crankcase 14 suspended vertically beneath motor 18. However, other orientations of the compressor components are contemplated and fall within the scope and spirit of the present invention.

Crankshaft 16 within crankcase 14 drives connecting rods 22 which are in turn connected to pistons 24 within cylinders 26. Cylinders 26 extend through the top surface of the crankcase 14.

A cylinder head 28 having a bottom surface 29 is operatively assembled onto the top surface of crankcase 14 by means of bolts (not shown). A valve plate 30, to which discharge and suction valves are mounted, is interposed between cylinder head 28 and crankcase 14. According to known methods of providing suction and discharge valving, FIG. 1 shows compressor 10 as having discharge valve retainers 32.

Cylinder head 28 includes discharge pressure chambers 34 and suction pressure chambers 36. During operation of compressor 10, the reciprocating piston action of pistons 24, together with the valves mounted on valve plate 30, produce regions of discharge pressure and suction pressure in chambers 34 and 36, respectively. A pressure relief valve 38, according to the present invention, is generally shown in FIG. 1 and will be described in more detail in conjunction with the remaining figures.

During operation of compressor 10, refrigerant enters housing 12 through a housing suction inlet 40. Because inlet 40 opens into the interior of housing 12, the compressor of FIG. 1 operates with the interior at suction pressure. The refrigerant within the housing 12 enters into suction chambers 36 by means of a suction muffler (not shown). The refrigerant is then drawn into cylinders 26 by the reciprocating action of pistons 24 together with the action of the suction valves on valve plate 30. During an exhaust stroke of pistons 24, pressurized refrigerant is introduced into discharge chambers 34 by the action of the discharge valves on valve plate 30. During normal operation of compressor 10, the pressurized refrigerant in discharge chambers 34 exits cylinder head 28 through discharge muffler 42 attached to cylinder head boss 44. From muffler 42, the refrigerant is carried to the outside of housing 12 through discharge outlet tube 46.

In the event that the pressure in discharge chambers 34 becomes excessive to the point that possible damage may occur to compressor components, pressure relief valve 38 provides a path between high pressure and low pressure zones by venting discharge chambers 34 into compressor housing 12. The venting of high pressure gas into housing 12 tends to increase the motor load and the temperature therein, which may be used to operate a thermal cutout for motor 18.

Figure 2:
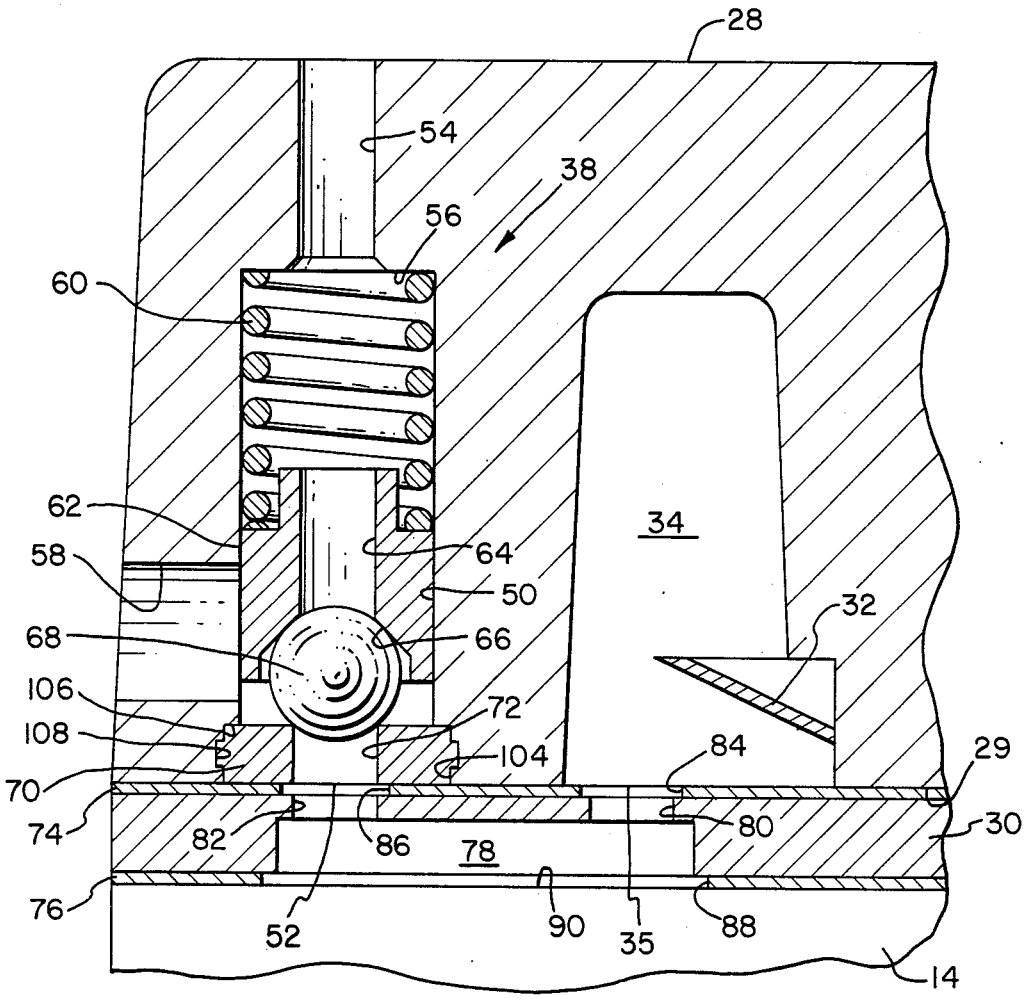
FIG. 2 is an enlarged fragmentary sectional view of a portion of the compressor of FIG. 1, particularly showing the pressure relief valve of the present invention.
Figure 6:
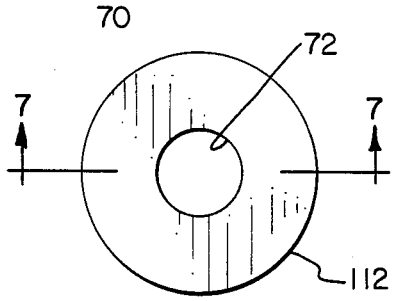
FIG. 6 is a plan view of a valve seat for the pressure relief valve of FIG. 2.

Referring now to FIG. 2 for a more detailed description of pressure relief valve 38, there is shown a portion of cylinder head 28, valve plate 30, and crankcase 14, including pressure relief valve 38 and discharge pressure chamber 34.

Pressure relief valve 38, in one form thereof, comprises a valve bore 50 extending between the bottom and top surfaces of cylinder head 28 substantially perpendicularly thereto. Valve bore 50 includes a valve opening 52 in the bottom surface of cylinder head 28 and, in one form thereof, includes an adjustment hole 54 extending from the valve bore bottom 56 to the top surface of cylinder head 28. A vent hole 58 intersects valve bore 50 at a substantially perpendicular angle so as to communicate with the side surface of cylinder head 28.

Within valve bore 50 there is provided a valve spring 60 and a valve piston 62 having a hole extending longitudinally therethrough. Piston 62 also includes a bevelled opening 66 at one end thereof which is operable to seat a valve ball 68. During static operation of pressure relief valve 38, i.e., the valve is closed, valve spring 60 is biased against valve bore bottom 56 and piston 62 to force valve ball 68 against a valve seat 70. Valve seat 70 includes a valve seat aperture 72 which communicates with valve opening 52.

When cylinder head 28 is assembled onto crankcase 14 as shown in FIG. 2, valve seat 70 is positively retained within valve bore 50 by a combination of cylinder head gasket 74, valve plate 30, valve plate gasket 76, crankcase 14, and the cylinder head bolts (not shown).

Figure 4:
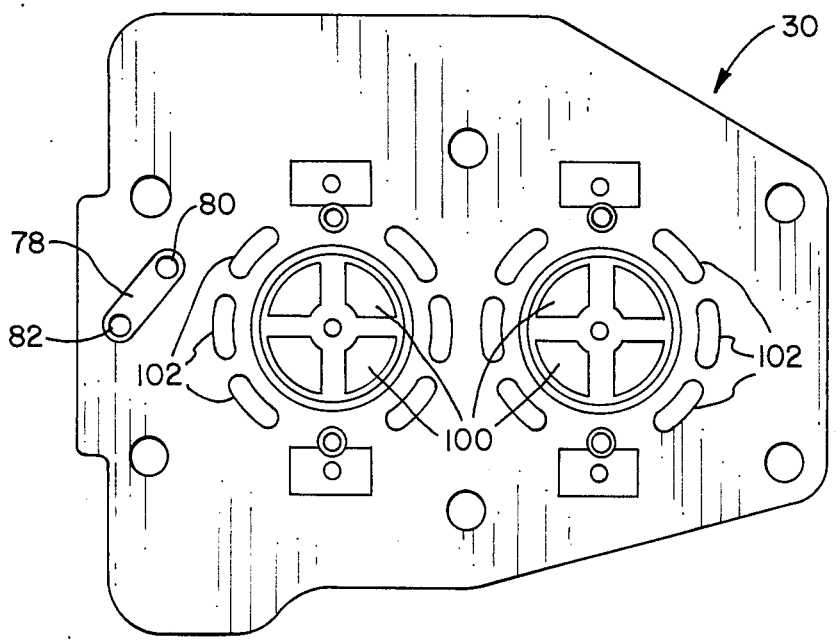
FIG. 4 is an enlarged plan view of a valve plate for use with the compressor of FIG. 1.

As previously described, valve bore 50 communicates with the bottom surface 29 of cylinder head 28 through a valve opening 52. Similarly, discharge chamber 34 communicates with bottom surface 29 through a discharge opening 35. In order to provide a path external to cylinder head 28 between discharge opening 35 and valve opening 52, a duct 78 is formed in valve plate 30. As shown in FIGS. 2 and 4, duct 78 is open to the bottom surface of valve plate 30. A discharge passage hole 80 and a valve passage hole 82 are located at opposite ends of oval duct 78 and communicate with the top surface of valve plate 30. Opening 84 in cylinder head gasket 74 provides communication between discharge opening 35 and discharge passage hole 80. In like manner, opening 86 in cylinder head gasket 74 provides communication between valve opening 52 and valve passage hole 82. Also, opening 88 in valve plate gasket 76 is slightly larger than duct 78 so that duct 78 is directly adjacent to top surface 90 of crankcase 14 rather than gasket 76. Accordingly, gasket 76 is totally contained between valve plate 30 and crankcase 14 so that raw edges of gasket 76 are not subjected to high velocity gas causing loose fibers to break loose and enter the system. Also, opening 88 in gasket 76 provides additional passage area to duct 78.

In assembled configuration, pressure relief valve 38 according to the present invention, as shown in FIG. 2, operates in the following manner. During normal levels of discharge pressure in pressure chamber 34, valve ball 68 is biased against valve seat aperture 72 by valve spring 60 and piston 62. Under such conditions, discharge pressure in duct 78 is prevented from escaping outside cylinder head 28 by virtue of cylinder head gasket 74 and valve plate gasket 76. In this way, the gaskets normally required in assembling compressor 10 serve an additional function of mounting pressure relief valve 38.

When discharge pressure within discharge chamber 34 exceeds a predetermined value established by the strength of valve spring 60 and the extent to which valve ball 68 is seated in valve seat aperture 72, valve ball 68 unseats against the force of valve spring 60 and allows discharge pressure to be vented through vent hole 58 into compressor housing 12. Because compressor housing 12 is at suction pressure, the high and low pressure sides of compressor 10 tend toward equalization, thereby correcting the overpressure condition. The valve ball 68, in the illustrated embodiment of the present invention, remains open until a thermal cutout for the motor opens and temporarily shuts off the compressor. When the compressor shuts off, the valve ball 68 reseats in valve seat aperture 72. Having a valve that remains open until the compressor is shut off is preferred over a valve that would oscillate on and off, thereby causing undue stress on the valve.

It should be appreciated that, while vent hole 58 is intended to be the primary path through which discharge pressure is vented into housing 12, adjustment hole 54 provides a secondary path as discharge pressure passes around valve piston 62. It is contemplated that adjustment hole 54 could constitute the sole means for venting discharge pressure.

Figure 3:
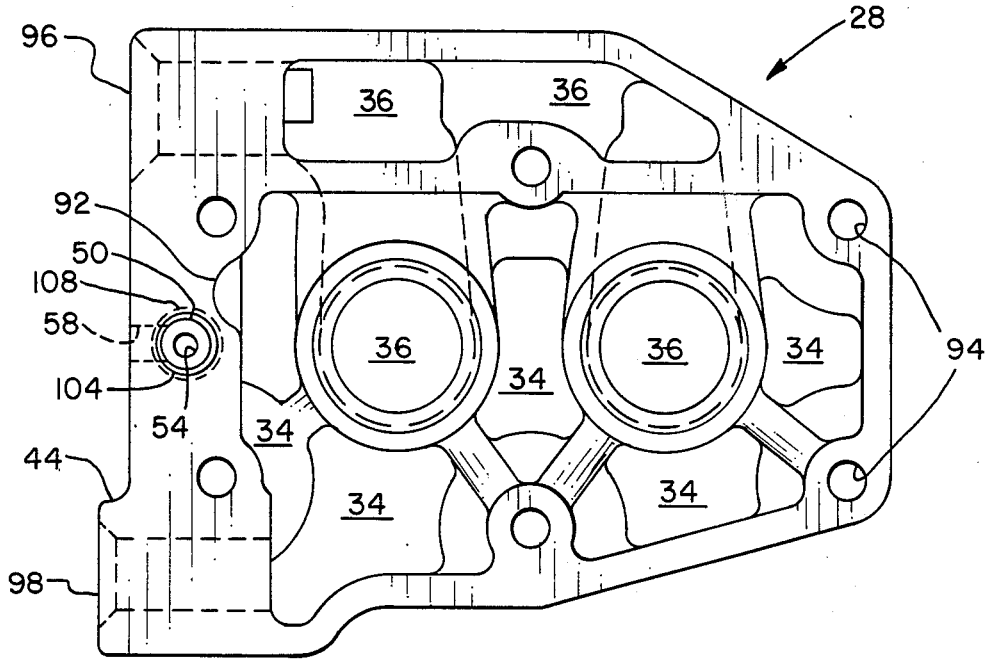
FIG. 3 is an enlarged internal view of a cylinder head for the compressor of FIG. 1.

FIG. 3 is a bottom view of cylinder head 28 as modified to accept the pressure relief valve of the present invention. In addition to showing valve bore 50, adjustment hole 54, and vent opening 58, FIG. 3 shows multiple head bolt holes 94, cylinder head suction inlet 96, and cylinder head discharge outlet 98. As illustrated, inlet 96 communicates with suction chambers 36 and outlet 98 communicates with discharge chambers 34.

FIG. 4 is a top view of valve plate 30 as modified to practice the present invention. Specifically, the angular orientation of duct 78 allows discharge passage hole 80 to be located substantially over a recess 92 of discharge chamber 34 in cylinder head 28 as shown in FIG. 3. Also shown in FIG. 4 are suction ports 100 and annular discharge ports 102 that are located substantially over cylinders 26 when compressor 10 is assembled. As previously described, typical suction valves and discharge valves are attached to valve plate 30 in operative fashion. Valve plate 30 is made of a sintered metal material, thereby enabling forming details such as duct 78 without need for machining.

An important aspect of the present invention relates to a method of assembling the pressure relief valve in a compressor. Specifically, as a step in assembling a compressor, pressure relief valve 38 is assembled into cylinder head 28 and retained therein by means for holding the valve components in valve bore 50. Valve bore 50 includes a valve seat countersink 104 which is coaxial with valve bore 50 near valve opening 52 and has a diameter greater than valve bore 50. In such an arrangement, an annular ledge 106 is provided on which valve seat 70 may rest. An annular undercut 108 is provided in the side of valve seat countersink 104.

In practicing the method of assembly according to the present invention, valve seat 70 is made of a compressible and expansible material For example, 2011-T3 aluminum is used in the preferred embodiment. Other suitable materials having similar characteristics may be used without departing from the spirit or scope of the present invention.

The method of assembly generally involves providing valve bore 50 in cylinder head 28, introducing the valve mechanism into valve opening 52, and retaining the valve mechanism within valve bore 50 until it can be positively held therein by crankcase 14 and valve plate 30 when compressor 10 is completely assembled. The valve mechanism includes valve spring 60, valve piston 62, valve ball 68, and valve seat 70.

Figure 5:
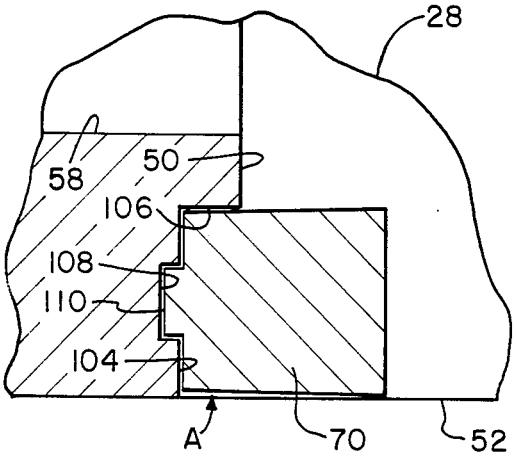
FIG. 5 is an enlarged fragmentary sectional view of the cylinder head for the compressor of FIG. 1, particularly showing the valve seat after it has been expanded into the undercut.
Figure 7:
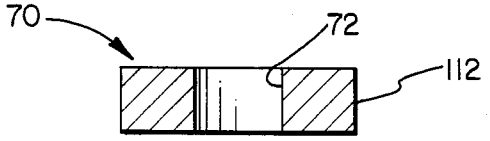
FIG. 7 is a sectional view of the valve seat of FIG. 6, taken along the line 7—7 in FIG. 6 and viewed in the direction of the arrows.

Means for holding the valve mechanism within cylinder bore 50 is illustrated in FIG. 5 and generally includes valve seat 70 in cooperative engagement with undercut 108 in countersink 104. In the preferred method of creating an annular expansion 110 on the outer wall surface 112 of valve seat 70, valve seat 70 is positioned within countersink 104 so as to rest on annular ledge 106 and be substantially coplanar with annular undercut 108. Valve seat 70 is then compressed by preferably applying a force in the direction of arrow "A" to the annular area of valve seat 70 supported therebeneath by annular ledge 106. This method of compressing valve seat 70 is preferred so that valve aperture 72 will not be deformed, thereby affecting normal operation of pressure relief valve 38.

Upon compression of valve seat 70, annular expansion 110 is received in locking fashion with annular undercut 108 to retain the valve mechanism within valve bore 50 until cylinder head 28 is mounted onto crankcase 14. In compressing valve seat 70, it is intended that it be coined, crimped, or otherwise forced into the relief represented by annular undercut 108.

After assembly of cylinder head 28 to crankcase 14, the valve mechanism is positively retained within valve bore 50 by crankcase 14, valve plate 30, and the cylinder head bolts.

To calibrate pressure relief valve 38, a tool is inserted into calibration hole 54. The punch-like tool extends through valve spring 60 and hole 64 in valve piston 62 before coming to rest on valve ball 68. The tool is then struck in order to bed the ball 68 into valve aperture 72 until pressure relief valve 38 tests within the desired actuation pressure range. Because seating valve ball 68 into valve aperture 72 lowers the valve actuation point, the components of the valve mechanism are designed so as to initially cause actuation at pressure higher than what is desired.

When a compressor incorporating the compression relief valve of the present invention is rebuilt or reconditioned, adjustment hole 54 may be used as a punch-out opening in order to unseat valve seat 70 from engagement with undercut 108. In this way, new valve mechanism components may be replaced without replacing the entire valve body as is required with a typical pressure relief valve having a separate valve body rather than a bore formed in cylinder head 28.

It will be appreciated that the foregoing description of a preferred embodiment of the present invention along with an alternative embodiment thereof, is presented by way of illustration only (and not by way of any limitation) and that various alternatives and modifications may be made to the illustrated embodiment without departing from the spirit and scope of the invention.

What is claimed is:

1. In a hermetic reciprocating piston compressor including, in assembled order, a cylinder head, a cylinder head gasket, a valve plate, a valve plate gasket, and a crankcase, the cylinder head having a discharge pressure chamber communicating with the bottom surface of the cylinder head through a discharge aperture, a pressure relief valve, comprising:

a valve body defined by a bore in the cylinder head, the valve body including an inlet aperture communicating with the bottom surface of the cylinder head and an outlet aperture communicating with a source of compressor suction pressure;

a pressure valve mechanism located within the valve body providing pressure relief valving between the inlet aperture and outlet aperture said pressure valve mechanism including an apertured piston, a ball and a spring; means for retaining said valve mechanism in said valve body including a deformable disk-shaped valve seat member having a through aperture therein, said valve seat member contacting said cylinder head gasket and secured in said valve body by an annular undercut in said valve body, said spring contracting said apertured piston to bias said ball against said valve seat member; and duct means external to the cylinder head for providing sealed communication between the discharge aperture and the inlet aperture, whereby excessive pressure in the discharge chamber is vented successively through the discharge aperture, the duct means, the inlet aperture, the valve mechanism, and the outlet aperture into the source of compressor suction pressure.

2. The compressor assembly of claim 1 in which:

the valve seat member is manufactured from an aluminum material.

3. The compressor assembly of claim 1 in which:

the valve body includes a calibration hole extending axially from the bore to the top surface of the cylinder head, the calibration hole providing communication from the outside of the cylinder head to the inside of the valve body for inserting a tool to adjust the extent to which the ball seats in the deformable valve seat member, thereby enabling adjustment of the pressure limit in the discharge chamber above which the pressure relief valve will operate.

4. The compressor assembly of claim 1 in which:

the duct means comprises a passageway formed in the valve plate, the passageway having one end aligned with the discharge aperture and another end aligned with the inlet aperture when the compresosr is assembled.

5. The compressor of claim 4 in which:

the passageway formed in the valve plate is defined by a first passage hole and a second passage hole, both the first and the second passage hole extending from the top surface of the valve plate adjacent to the cylinder head to the bottom surface of the valve plate adjacent to the crankcase, and a channel extending from the first passage hole to the second passage hole and communicating with the bottom surface of the valve plate.

* * * * *